United States Patent [19]

Bassett et al.

[11] Patent Number: 4,903,674

[45] Date of Patent: Feb. 27, 1990

[54] SPARK DEVELOPING APPARATUS FOR INTERNAL COMBUSTION ENGINES

[75] Inventors: Norris J. Bassett; James A. Boyer, both of Anderson; John B. Savage, Indianapolis, all of

[73] Assignee: General Motors Corporation, Detroit, Mich.

[21] Appl. No.: 322,374

[22] Filed: Mar. 13, 1989

[51] Int. Cl.[4] ..... F02P 3/02

[52] U.S. Cl. ..... 123/634; 123/635; 123/647; 123/169 PA; 315/57

[58] Field of Search ..... 123/608, 620, 634, 635, 123/643, 647, 169 CA, 169 PA; 315/57

[56] References Cited

U.S. PATENT DOCUMENTS

| | | | |
|---|---|---|---|
| 1,164,113 | 12/1915 | Orswell | 315/57 |
| 1,302,308 | 4/1919 | Cavanagh | 315/51 |
| 1,326,366 | 12/1919 | Milton | 123/169 PA X |
| 2,441,047 | 5/1948 | Wall | 315/57 |
| 2,459,856 | 1/1949 | Wall | 315/57 |
| 2,467,531 | 4/1949 | Lamphere et al. | 315/57 |
| 2,467,534 | 4/1949 | Osterman | 315/57 |
| 4,617,907 | 10/1986 | Johansson et al. | 123/647 |
| 4,706,639 | 11/1987 | Boyer et al. | 123/647 |
| 4,825,844 | 5/1989 | Fasola | 123/634 X |
| 4,834,056 | 5/1989 | Kawai | 123/634 |
| 4,841,944 | 6/1989 | Maeda et al. | 123/634 X |

FOREIGN PATENT DOCUMENTS

| | | | |
|---|---|---|---|
| 1232399 | 1/1967 | Fed. Rep. of Germany PA | 123/169 |
| 0185877 | 10/1984 | Japan | 123/635 |

*Primary Examiner*—Willis R. Wolfe

*Attorney, Agent, or Firm*—C. R. Meland

[57] ABSTRACT

Apparatus for developing and applying sparks to the combustion chamber of an internal combustion engine. The apparatus comprises separate primary and secondary winding units. The secondary unit includes a spark plug having an insulator. The insulator carries a secondary coil winding which is connected to the electrodes of the spark plug. The insulator has a bore which contains a magnetic core for the secondary winding. The primary winding unit includes a primary winding and a tubular flux carrying part formed of magnetic material. The primary winding unit has a bore which is slipped over a portion of the secondary unit that has the secondary winding. A voltage is induced in the secondary winding by magnetic coupling to the primary winding when it is energized.

20 Claims, 4 Drawing Sheets

SPARK DEVELOPING APPARATUS FOR INTERNAL COMBUSTION ENGINES

This invention relates to spark developing apparatus for igniting the combustible mixture supplied to a cylinder of an internal combustion engine and more particularly to such apparatus that includes a spark plug that has a winding that forms a secondary winding of an ignition coil.

Ignition apparatus for generating sparks to ignite the combustible mixture of a spark ignited internal combustion that combines a spark plug and an ignition coil into one unit have been proposed in the prior art. Thus, the U.S. Patents to Orswell U.S. Pat. No. 1,164,113, Cavanagh U.S. Pat. No. 1,302,308, Wall U.S. Pat. Nos. 2,441,047, 2,459,856, Lamphere et al U.S. Pat. No. 2,467,531 and Osterman U.S. Pat. No. 2,467,534 all disclose combined ignition coil and spark plugs.

The spark developing apparatus of this invention differs from the above-mentioned prior art in that, among other things, it utilizes a combined spark plug and secondary winding that form a unit that is separate from a primary winding unit. The secondary winding has a voltage induced therein solely by magnetic coupling to the primary winding of the separate primary winding unit.

Further, the combined spark plug and secondary winding unit has a magnetic core for forming a flux path for the magnetic flux developed by the separate primary winding unit.

It, accordingly, is one of the objects of this invention to provide a new and improved spark developing apparatus that combines into a single unit, a spark plug, a secondary winding and a magnetic core for the secondary winding.

Another object of this invention is to provide spark developing apparatus of the type described where the magnetic core is comprised of small particle size magnetic powder such as iron powder wherein the particles are electrically insulated from each other by insulating material that coats the particles.

Still another object of this invention is to provide apparatus for developing and applying sparks to a cylinder of an internal combustion engine that comprises a combined spark plug and secondary winding unit mounted on the engine and a primary winding unit that is separate from the secondary unit and wherein the primary unit has a primary coil winding that is magnetically coupled to the secondary winding of the secondary unit.

Still another object of this invention is to provide ignition apparatus of the type described wherein the primary winding of the primary unit is energized by a capacitor discharge ignition system.

IN THE DRAWINGS

Figure 1:
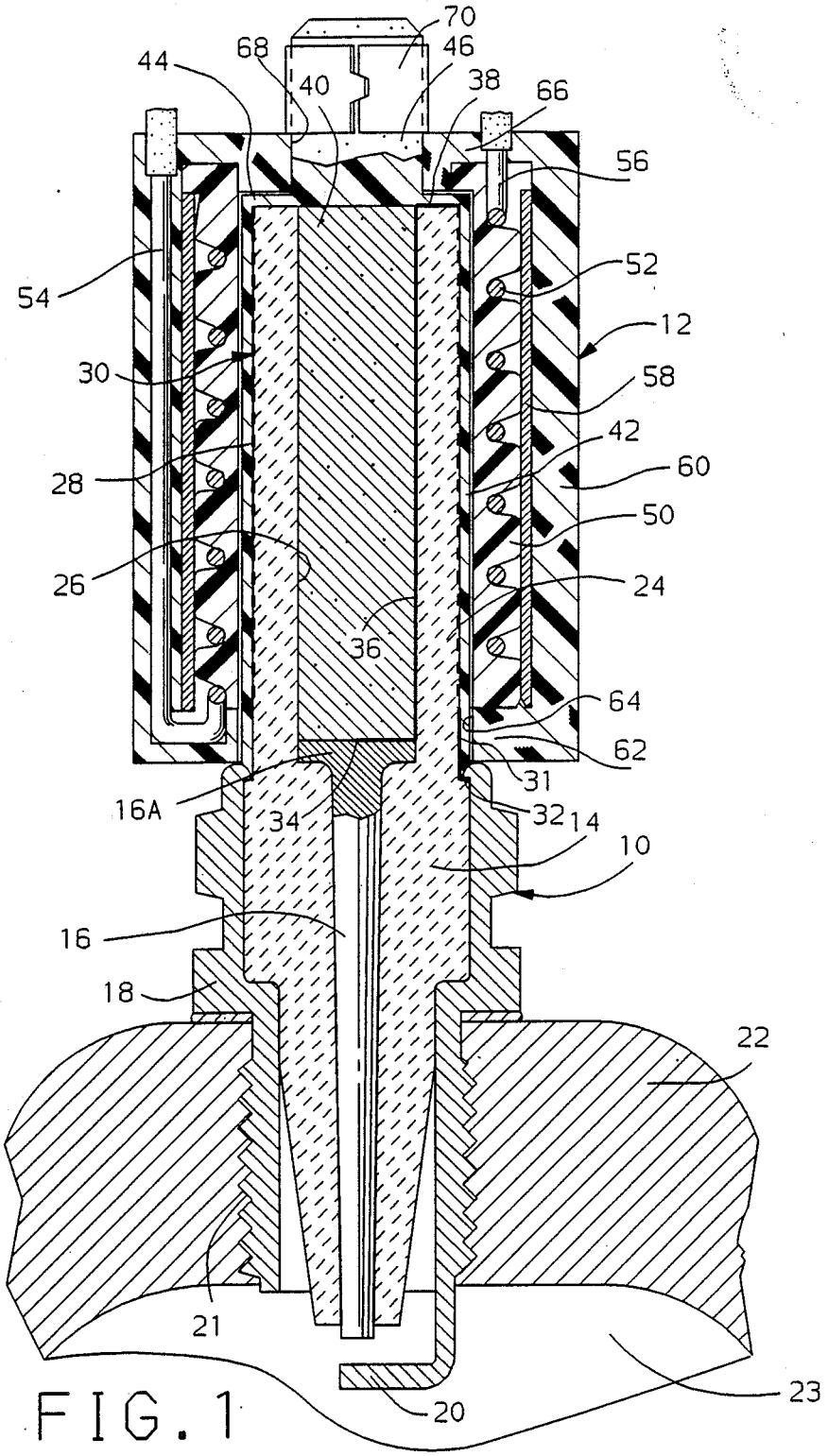
FIG. 1 is a sectional view of spark developing apparatus made in accordance with this invention mounted on an internal combustion engine.

Referring now to the drawings and more particularly to FIG. 1, a spark developing apparatus is illustrated that comprises two separate units generally designated respectively as 10 and 12. The secondary unit 10 comprises a spark plug, a secondary winding and a magnetic core. The primary unit 12 comprises a primary winding.

Unit 10 includes an insulator 14 which is formed of a suitable ceramic electrical insulating material. This ceramic material may be of the same type that is used for the insulator of a conventional spark plug. Thus, by way of example, and not by way of limitation, a ceramic material that has a high alumina base material containing upwards of 85% aluminum oxide may be used. The insulator 14 carries a metal center electrode 16. The insulator also carries an outer tubular metallic shell 18 which in turn carries electrode 20 located in arc gap relationship to the end of center electrode 16. The shell 18 has a threaded portion 21 which is shown in FIG. 1 threaded into a threaded spark plug opening in the head 22 of an internal combustion engine. The spark plug gap is located in a combustion chamber or cylinder 23 of the engine.

The insulator 14 has an axially extending annular tubular shaped portion 24 that has a tubular bore 26. The portion 24 has an outer cylindrical surface 28 and bonded to this surface is a spiral secondary winding 30. One end turn of winding 30 is electrically connected to shell 18 and hence to electrode 20 by strip conductor portions 31 and 32. Portion 32 is soldered or brazed to shell 18. The opposite end turn of secondary winding 30 is electrically connected to portion 16A of center electrode 16 by strip conductor portions 34, 36 and 38. Conductor portion 34 is soldered or brazed to an upper surface of portion 16A.

The conductor portions and secondary winding 30 are formed of metallic material such as copper which is bonded to the ceramic material of insulator 14. By way of example, the secondary winding 30 may be comprised of about 500 turns of metallic material with the conductor that forms a turn being about 0.001 inches wide and with the spacing between adjacent turns being about 0.001

The material may be about 0.001 inches thick. The winding 30 is a single layer winding.

The secondary coil winding 30 can be formed by metallizing the outer surface 28 of insulator portion 24 with a metallic conductor material that has a spiral pattern where the material is bonded to outer surface 28. The metallic material, which may be copper can be plated or deposited on the outer surface. The metallizing can be accomplished by a number of methods. For example, the outer surface 28 can be coated or plated with a metallic material and then portions of the metallic material is removed to form a spiral coil winding. The material can be removed by etching away a spiral pattern that ultimately forms spaces between adjacent turns of the secondary coil winding. The material could also be removed by use of a laser to evaporate a thin spiral pattern of metallic material. In general any known insulator metallizing process may be used to form winding 30 as long as the process used is capable of bonding a spiral metallized coil on the outer surface 28.

The winding 30 can be formed of a metallic material other than copper, for example tungsten or silver.

As an alternative, secondary winding 30 could be formed by tightly winding a fine copper magnet wire to outer surface 28 and then encapsulating the winding with a high temperature encapsulation material. By way of example the wire could be an Awg. No. 44 diameter magnet wire having a diameter of about 0.002 inches.

The bore 26 in insulator portion 24 contains a cylindrical magnetic core 40 that extends the entire length of bore 26. This core 40 is formed of a composite magnetic and electrical insulating material. By way of example core 40 can be formed of fine powdered iron particles where each particle is coated with an electrical insulating material such as a thermoplastic resin.

The particles may also be coated with other electrical insulating material that form a glass-like overcoat or film.

The core 40 can be formed by compacting coated iron powder in a suitable press to form a solid mass of magnetic material having a cylindrical shape. The electrical insulating material insulates the iron particles from each other. The insulation of the particles from each other performs the function of reducing eddy current loss in core 40.

After the secondary winding 30 and associated strip conductors have been formed, the core 40 is assembled by inserting it into bore 26. The core 40 is attached to insulator 14 by a suitable adhesive such as a ceramic cement which has not been illustrated.

After the core 40 has been assembled, the upper end of unit 10 is overmolded with a plastic molding material to form an outer housing having a tubular portion 42, an end wall 44 and a boss or post 46. The outer housing is an electrical insulator and also serves to seal the area containing the secondary winding 30 and associated conductors from moisture or other contaminants. The outer lower end of housing portion 42 is molded to the upper end of shell 18 such that it engages and is molded to an entire upper annular surface of shell 18.

The unit 12 may be termed a primary unit since it has a primary winding which, when energized, causes a spark firing voltage to be induced in secondary 30.

The primary unit 12 comprises a spool or coil form 50 that is formed of plastic electrical insulating material. The spool 50 carries a primary coil winding 52 which may be comprised of about seven turns of wire. It can be seen that the wire the forms winding 52 is wound into grooves formed in the exterior of coil spool 50. One end of coil winding 50 has an end lead or conductor 54 and the opposite end of coil winding 50 has an end lead or conductor 56.

The primary unit 12 has a tubular primary flux carrying part 58 that is formed of magnetic material and which engages coil spool 50. The part 58 forms a low reluctance magnetic path for flux developed by primary coil 52 when it is energized. The flux carrying part 58 may be formed of cold rolled steel or compacted powdered iron. The part 58 can be press-fitted to the coil spool 50. Where part 58 is formed of cold rolled steel, it may have an axial slit to allow the part 50 to expand slightly when it is assembled to coil spool 50.

The primary unit 12 has a cover or housing that is formed of a plastic insulating material that is overmolded to part 58 and coil spool 50. This housing is comprised of an axially extending tubular portion 60, a lower wall 62 which has an annular bore or opening 64 and an upper wall 66 which has an annular bore or opening 68.

In the use of this invention, the units 10 are assembled to an internal combustion engine in the same manner that a conventional spark plug is assembled to an engine, that is the threaded portion 21 is threaded into an appropriate threaded spark plug opening in the engine. With a unit 10 assembled to an engine, a primary unit 12 is now slipped over the upper end of unit 10 with the post 46 passing through bore 68. The lower surface of wall 62 engages an upper portion of shell 18. A metal retaining clip 70 is now fastened to post 46. This clip engages an outer surface of wall 66 of unit 12 and serves to hold the unit 12 in place relative to unit 10. There is sufficient clearance between the telescoped portions of units 10 and 12 to allow unit 12 to be slipped over the upper portion of unit 10.

Figure 5:
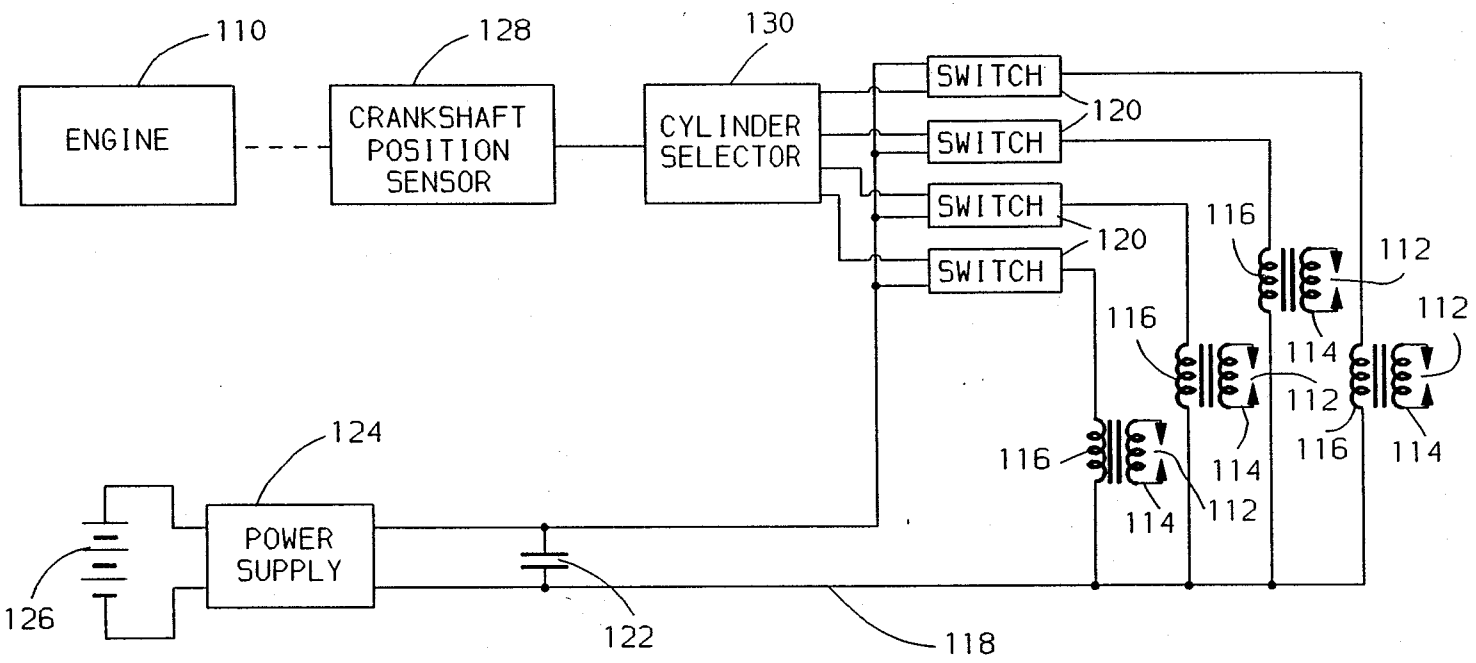
FIG. 5 is a schematic circuit diagram of an ignition system that utilizes the spark developing apparatus of this invention.

The primary winding 52 is energized by a capacitor discharge ignition system shown in FIG. 5. Whenever a primary winding is energized, it develops a flux field which is magnetically coupled to secondary winding 30. The flux path for flux generated by primary 52 has an inner and outer paths which are through magnetic material. The inner flux path is through the magnetic material of magnetic core 40 and the outer path is through tubular part 58 of primary unit 12.

It will be appreciated that there is no electrical connection between primary winding 52 and secondary winding 30. The voltage induced in secondary winding 30 is due solely to its magnetic coupling with primary winding 52. Further, the units 10 and 12 are separate parts.

When using the embodiment of the invention shown in FIG. 1, a plurality of units like unit 12 is required for a multi-cylinder engine. Thus, for a four cylinder engine, four units like unit 12 would be required. Each unit would be connected to a capacitor discharge ignition system by suitable cables. This is only one way of implementing this invention and as will be described in connection with FIG. 4, the units like unit 12 can be integrated into a single module that is secured to the engine. Further, where separate units like unit 12 are used, one for each unit 10, it is not necessary that the unit 10 be provided with means like post 46 for securing the unit 12 in place. Thus, separate units, like units 12 could be attached to the engine by suitable mounting brackets or hardware.

Figure 2:
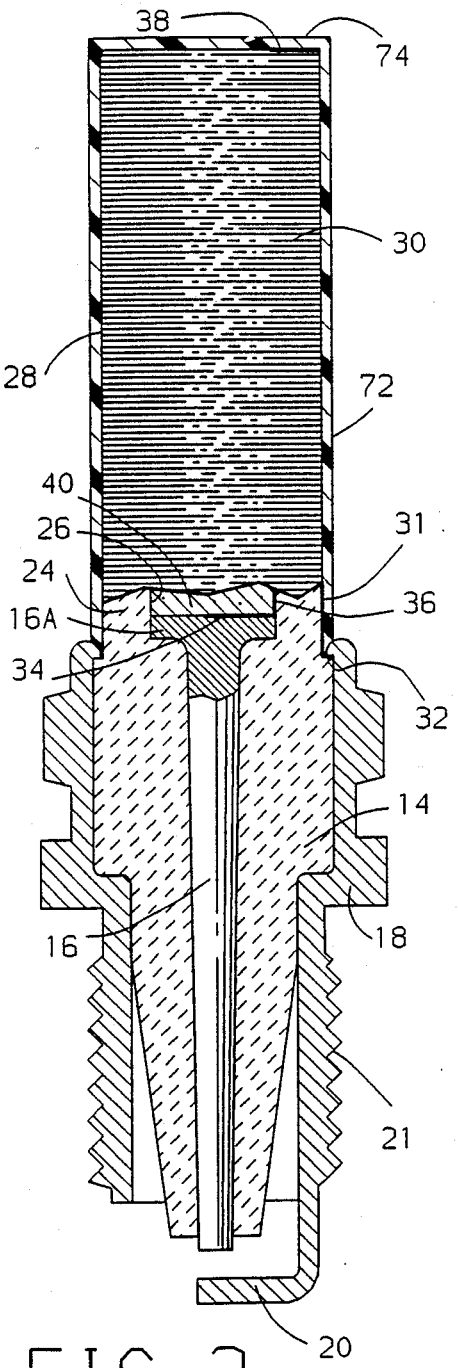
FIGS. 2 and 3 are sectional views of modified spark developing apparatus made in accordance with this invention.

Referring now to FIG. 2, a modified spark generating unit is illustrated. The unit shown in FIG. 2 has no means for securing a primary unit thereto and is adapted to be used with a primary module shown in FIG. 4 that is fastened to the engine. The spark developing unit shown in FIG. 2 is identical with unit 10 shown in FIG. 1 with the exception that it has no post like post 46. The unit of FIG. 2 has an outer plastic housing or cover comprised of a tubular portion 72 and integral end wall 74. The other parts in FIG. 2 have been identified by the same reference numerals as were used in FIG. 1 to identify corresponding parts.

Figure 3:
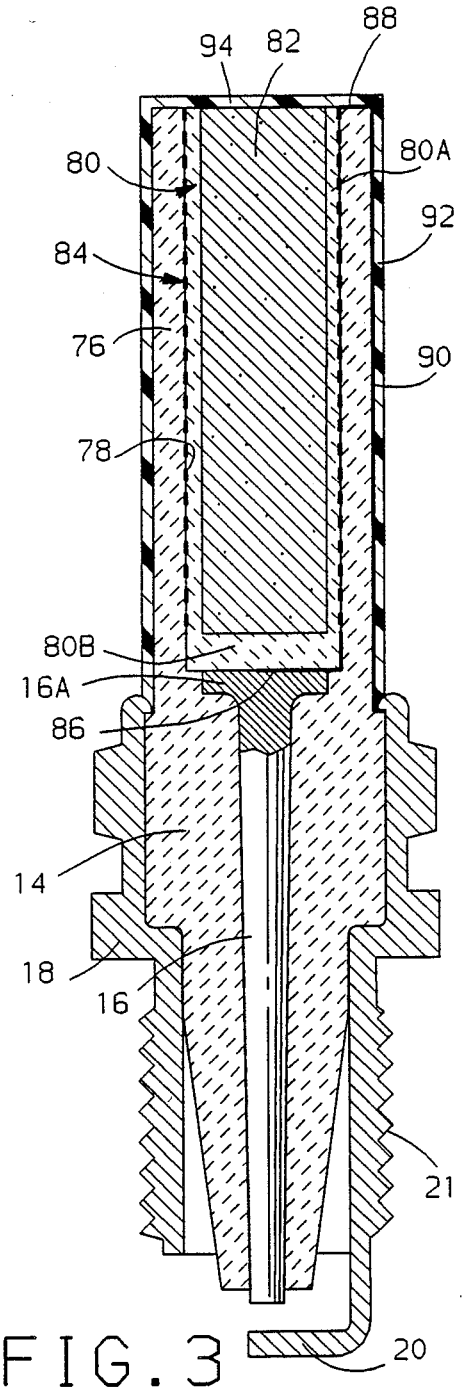

FIG. 3 illustrates still another modified spark developing unit. This unit like the unit shown in FIG. 2 is adapted to be used with the primary module shown in FIG. 4.

In the FIG. 3 unit the insulator 14 has an axially extending annular tubular shaped portion 76 provided with a bore 78. Disposed within bore 78 is a part 80 that is formed of a ceramic insulating material which may be of the same type that is used for insulator 14. The part 80 has a tubular portion 80A and a closed end 80B. The bore defined by portions 80A and 80B contains a magnetic core 82 which can be formed of the same type of magnetic material as the material that forms the core 40 of FIG. 1. Bonded to the outer surface of portion 80A is a secondary winding 84. One end of secondary winding 84 is connected to center electrode 16 by strip conductor 86. The other end of secondary winding 84 is connected to shell 18 and, hence, to electrode 20 by strip conductors 88 and 90. The secondary winding 84 can be formed in the same manner as the formation of secondary winding 30 which has been described in connection with FIG. 1.

In the assembly of the FIG. 3 embodiment, a unit that is comprised of part 80, core 82 and secondary winding 84 can be manufactured. This unit is then inserted into the bore of portion 76 and is secured in place by a suitable ceramic paste or cement. To make the connections to winding 84, the strip conductors are provided by, for example, by metallization. The connection to center electrode from strip conductor can be made by coating the contacting parts with silver solder and heating the solder to a bonding temperature.

In FIG. 3 the unit has an outer housing or cover that is formed of overmolded plastic material and which is comprised of tubular portion 2 and integral end wall 94. Since the secondary winding 84 is already covered by portion 76 of insulator 14, the outer housing or cover 92 and 94 may not be required. Thus, conductor strips 88 and 90 may remain exposed or alternatively could be covered by a thin film of insulating material or any other coating material that will provide some external protection and which would bond to strips 88 and 90.

Figure 4:
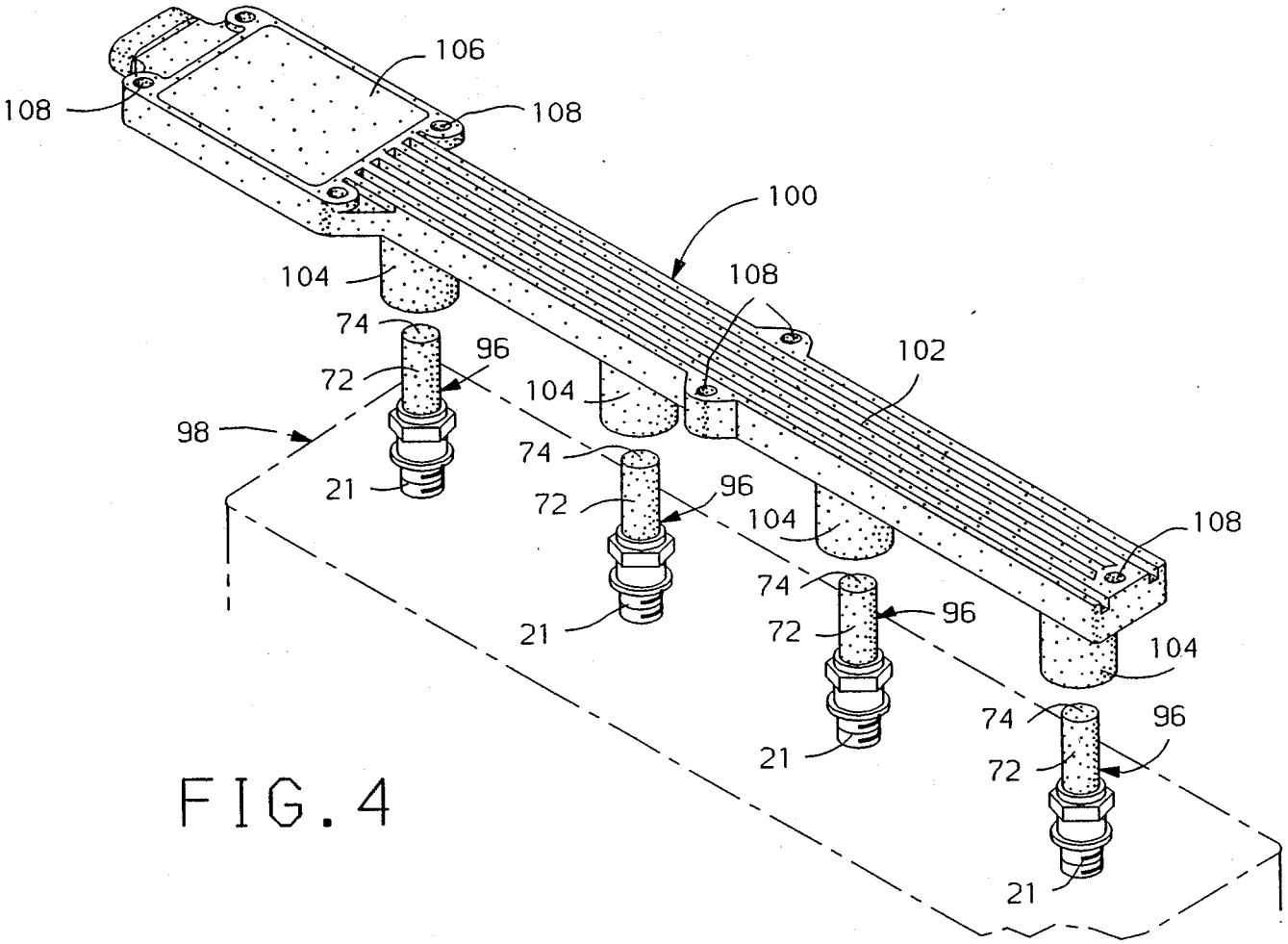
FIG. 4 is a perspective view illustrating the spark developing apparatus of this invention for use on a four cylinder engine.

As previously mentioned, the units shown in FIGS. 2 and 3 are adapted to be used with the primary module shown in FIG. 4. For the purpose of describing the arrangement shown in FIG. 4, it will be assumed that the secondary units used in FIG. 4 are identical with the unit shown in FIG. 2.

In FIG. 4, four secondary units each designated as 96 are shown associated with a four cylinder spark ignited internal combustion engine 98. The threaded portions 21 of each unit is threaded into threaded spark plug openings in engine 98 that communicate with the cylinders of the engine.

In FIG. 4 the reference numeral 100 generally designates a primary winding module that has four primary winding units integrated into one package. The module 100 has an elongated housing or support 102 which is formed of plastic insulating material and which carries four integral tubular parts each designated as 104. Each part 104 contains a primary winding and tubular metallic flux carrying part. More specifically, each tubular part 104 has a coil spool like spool 50 that carries a primary winding like winding 52 and a magnetic flux carrying part like part 58. The outer plastic housing of each unit 104 can be like housing 60 (FIG. 1) and as mentioned is integral with the support or body portion 102. The respective primary windings of units 104 are connected to a capacitor discharge ignition system contained in portion 106 of module 100 by conductors that are located in body or support portion 102.

In the use of the FIG. 4 arrangement, let it be assumed that units 96 have been screwed into the appropriate threaded spark plug openings in engine 98. The module 100 is now assembled to the engine by slipping the primary windings in parts 104 over the top ends of units 96 so that the relationship of the primary and secondary units is like that shown in FIG. 1. There is sufficient clearance between the parts to allow the top ends of the secondary units to telescope into the cool spools located in parts 104 that carry the primary windings when module 100 is assembled to the engine. The module 100 is secured to engine 98 by suitable bolts or screws not illustrated that can pass through openings 108. The bolts or screws are attached to suitable parts of the engine which may include mounting brackets secured to and carried by the engine. It should be understood that the units 96 can be located in spark plug wells formed in the head of the engine in a manner disclosed in the U.S. Pat. No. 4,706,639 to Boyer et al.

Referring now to FIG. 5, a capacitor discharge ignition system is illustrated. In FIG. 5 the reference numeral 110 designates a four cylinder spark ignited internal combustion engine. The spark gap electrodes of each secondary unit associated with each cylinder have each been designated as 112. These electrodes correspond to electrodes 16 and 20. The electrodes 112 are connected respectively to opposite ends of secondary windings 114. Each secondary winding 114 corresponds to, for example, secondary winding 30. Each secondary winding 114 is associated with a primary winding 116. Each primary winding 116 corresponds to primary winding 52.

The primary windings 116 are connected between conductor 118 and respective semiconductor switches 120 that are turned on in a predetermined sequence to be described. Switches 120 may be controlled rectifiers.

The system of FIG. 5 has a capacitor 122 which is discharged into a primary winding 116 when one of the switches 120 is turned on. The capacitor 122 is charged from a direct voltage power supply 124 which may take the form of a D.C. to D.C. converter. Power supply 124 receives input voltage from a 12 volt battery 126 on a motor vehicle. The power supply 124 transforms the 12 volt input to about 400 or 500 volts output which is used to charge capacitor 122.

The engine 110 drives a crankshaft position sensor 128 which develops electrical signals indicative of engine crankshaft angular position. The output of sensor 128 is connected to a cylinder selector circuit 130 which has four outputs connected respectively to switches 120. The system operates such that switches 120 are sequentially turned on in synchronism with rotation of the crankshaft of engine 110. Each time that a switch 120 is turned on, the capacitor 122 discharges through one of the primary windings 116 which, in turn, causes a voltage to be induced in an associated secondary winding that is high enough to cause a spark or arc to be developed across one pair of electrodes 112.

The circuit shown in FIG. 5 can be used in an arrangement where separate primary winding units are associated respectively with a secondary unit like FIG. 1 or can be used where all of the primary windings are parts of a module like the module 100 shown in FIG. 4. In the FIG. 4 arrangement the conductors connecting the capacitor discharge ignition system to the primary windings are located in elongated housing 102.

The tubular metallic parts 58 are not required but if not used the efficiency of the ignition system would be reduced. If parts 58 are not used the housing portion like portion 60 would be molded to outer surfaces of the coil spool 50 and to the primary winding 52.

The embodiments of the invention in which an exclusive property or privilege is claimed are defined as follows:

1. Apparatus for developing sparks to ignite the combustible mixture in a cylinder of an internal combustion engine comprising, an internal combustion engine having a cylinder, a secondary spark developing unit comprising a spark plug supported by said engine having a pair of electrodes associated with said cylinder, said spark plug having first insulator means for supporting and for electrically insulating said electrodes from each other and having second insulator means extending axially of said first insulator means, said second insulator means having a bore, a core formed of a magnetic material located within said bore, a secondary coil winding carried by said second insulator means and disposed about said core, the opposite ends of said secondary winding being electrically connected respectively to said electrodes, means for causing a voltage to be induced in said secondary winding which is high enough to cause an arc to be developed across said electrodes comprising a primary winding unit that is a part that is separate from said secondary spark developing unit, said primary winding unit having a bore, and means for supporting said primary winding unit relative to said secondary spark developing unit such that said second insulator means, said secondary winding and said core are located within said bore, said primary winding unit having a primary winding disposed about said bore, said primary winding when energized developing a magnetic flux that passes through said core to induce said voltage in said secondary winding, said primary winding unit being completely separable from said secondary spark developing unit.

2. The apparatus according to claim 1 where said first and second insulator means is comprised of a one-piece insulator.

3. The apparatus according to claim 1 where said second insulator means comprises a tubular member disposed within an axially extending insulator that is an integral extension of said first insulator means.

4. The apparatus according to claim 1 where said primary winding is energized by a capacitor discharge ignition system.

5. The apparatus according to claim 1 where said primary winding unit has a tubular member that is formed of magnetic material that forms a flux path for magnetic flux developed by said primary winding.

6. The apparatus according to claim 1 where said primary winding unit is mounted on said engine.

7. A spark developing unit for igniting the combustible mixture of a spark ignited internal combustion engine that is adapted to be magnetically coupled to a primary winding comprising, a one-piece insulator having first and second integral portions, said first portion supporting a pair of electrodes that define a spark gap, said second portion having a tubular shape defining a bore and extending axially of said first portion, a core formed of magnetic material located in said bore, a coil winding carried by an outer surface of said second portion and disposed about said core, and means electrically connecting opposite ends of said coil winding respectively to said electrodes.

8. The spark developing unit according to claim 7 where said winding is comprised of turns of metallic material that are bonded to said outer surface of said second portion.

9. The spark developing unit according to claim 7 where one of said electrodes is connected to a metallic shell that is supported by said first portion and wherein said shell has an external threaded portion that is adapted to be threaded into a threaded spark plug opening in an engine.

10. The spark developing unit according to claim 7 where said magnetic core is formed of a composite magnetic powder and electrical insulating material.

11. The spark developing unit according to claim 7 where said winding is covered by an outer housing formed of insulating material.

12. The spark developing unit according to claim 7 where said insulator is formed of a ceramic material.

13. The spark developing unit according to claim 7 where said unit has a tubular metallic shell which is electrically connected to one of said electrodes and wherein the portion of said unit that extends axially of said shell is entirely enclosed by an outer housing formed of electrical insulating material, a portion of said housing engaging a portion of said shell.

14. A spark developing unit for igniting the combustible mixture of a spark ignited internal combustion engine that is adapted to be magnetically coupled to a primary winding comprising, a first one-piece insulator having first and second integral portions, said first portion supporting a air of electrodes that define a spark gap, said second portion having a tubular shape defining a bore and extending axially of said first portion, a second tubular insulator disposed within said bore of said second portion, a magnetic core located within said second tubular insulator, a coil winding carried by an outer surface of said second insulator and disposed about said core, and means electrically connecting opposite ends of said coil winding respectively to said electrodes.

15. The spark developing unit according to claim 14 where said winding is comprised of turns of metallic material that are bonded to said outer surface of said second insulator.

16. The spark developing unit according to claim 14 where said first and second insulators are both formed of ceramic material.

17. The spark developing unit according to claim 14 where said unit has a tubular metallic shell which is electrically connected to one of said electrodes and wherein the portion of said unit that extends axially of said shell is entirely enclosed by an outer housing formed of electrical insulating material, a portion of said housing engaging a portion of said shell.

18. A spark developing unit for igniting the combustible mixture in a cylinder of a spark ignited internal combustion engine comprising, a spark plug having an insulator, a center electrode carried by said insulator, a tubular metallic shell having an external threaded piston and an electrode carried by said shell, said threaded portion being adapted to be threaded into a threaded spark plug opening in an engine, said insulator having an axially extending portion extending axially of said shell and away from said electrodes, a core formed of magnetic material located within said axially extending portion of said insulator, a coil winding formed of metallic material bonded to a surface of said axially extending portion of said insulator and disposed about said core, means connecting opposite ends of said coil winding respectively to said electrodes, and a housing engaging and extending from one end of said shell which entirely encloses said axially extending insulator portion and said coil winding.

19. The spark developing unit according to claim 18 where said housing is formed of a plastic electrical insulating material that is molded to said axially extending portion of said insulator.

20. The spark developing unit according to claim 18 where said insulator is formed of ceramic insulating material.

* * * * *